US006363992B1

(12) United States Patent
Semmler

(10) Patent No.: US 6,363,992 B1
(45) Date of Patent: Apr. 2, 2002

(54) MANUAL DEVICE FOR TRANSFERRING A FILM FROM A SUPPORTING STRIP TO A SUBSTRATE

(75) Inventor: Georg Semmler, Wiesbaden (DE)

(73) Assignee: BIC Deutschland GmbH & Co., Liederbach (DE)

( * ) Notice: Subject to any disclaimer, the term of this patent is extended or adjusted under 35 U.S.C. 154(b) by 0 days.

(21) Appl. No.: 09/688,546

(22) Filed: Oct. 16, 2000

Related U.S. Application Data

(63) Continuation of application No. PCT/EP99/02546, filed on Apr. 15, 1999.

(30) Foreign Application Priority Data

Apr. 16, 1998 (DE) ..... 198 16 925

(51) Int. Cl.[7] ..... B32B 31/00

(52) U.S. Cl. ..... 156/577; 156/523; 156/579; 118/76; 242/160.4; 242/171; 242/588.6

(58) Field of Search ..... 156/238, 523, 156/527, 540, 574, 577, 579; 225/46; 242/160.2, 160.4, 588, 588.2, 588.3, 588.6, 170, 171; 118/76, 200, 257

(56) References Cited

U.S. PATENT DOCUMENTS 3,969,181 A 7/1976 Seabold ..... 156/577
5,346,588 A 9/1994 Elges et al. ..... 156/140
5,379,477 A * 1/1995 Tamai et al. ..... 118/257 X
5,770,007 A 6/1998 Czech et al. ..... 156/540
5,897,742 A * 4/1999 Semmler ..... 156/577
6,273,982 B1 * 8/2001 Semmler ..... 156/238

FOREIGN PATENT DOCUMENTS

DE 4220712 1/1994

* cited by examiner

*Primary Examiner*—Mark A. Osele
(74) *Attorney, Agent, or Firm*—Pennie & Edmonds LLP

(57) ABSTRACT

A device for transferring a film from a tape carrier to a substrate. The device, otherwise known as a tape applicator, has a housing in which are arranged a supply wheel for the tape carrier coated with the film, and a take-up wheel (displaced radially with respect to the supply wheel) for receiving the tape carrier once the film has been separated therefrom. An application device, projects from the housing and presents the side of the tape carrier coated with film to the substrate. A drive connection together with a slip coupling is formed between the supply wheel and the take-up wheel by a friction drive, in which, when the supply wheel is driven by drawing off the tape carrier, the drive connection drives the take-up wheel at such a rotational speed that the tape carrier remains always tensioned. In order to improve the transfer of torque between the wheels, the wheels each have at least one disc-shaped wheel wall. The wheel wall of one wheel is formed with a slit and the wheel wall of the other wheel engages in the slit and is clamped therein. Rotational movement is thus transmitted from one wheel to the other.

14 Claims, 3 Drawing Sheets

MANUAL DEVICE FOR TRANSFERRING A FILM FROM A SUPPORTING STRIP TO A SUBSTRATE

CROSS-REFERENCE TO RELATED APPLICATION

This application is a continuation of International Application No. PCT/EP99/02546 filed Apr. 15, 1999, the content of which is expressly incorporated herewith.

FIELD OF THE INVENTION

The present invention relates to a manual device for transferring a film of, for example, an adhesive, a covering, or a colored material from a supporting strip to a substrate. More particularly, the present invention relates to an improved manner by which wheels supplying and taking up the supporting strip may be movably coupled together to mutually transmit movement therebetween.

BACKGROUND OF THE INVENTION

A manual device for transferring a film from a supporting strip to a substrate is known, for example, from DE-C2-42 20 712 filed by the Applicants, in which a supply wheel and a take-up wheel are in direct frictional contact with each other. The drive connection and slip coupling are formed as one piece by small and simple structural parts so that no additional parts for the drive connection and slip coupling are required and a simple and inexpensive production is achieved.

The wheels of the manual device illustrated in DE-C2-42 20 712 have in each case a hub part from which project lateral wheel walls in the form of round discs, between which the supporting strip is taken up and wound. The drive connection together with the integrated slip coupling is formed by at least one pair of frictional surfaces engaging directly with each other, which surfaces are formed on mutually opposite inner and outer sides of the disc-shaped wheel walls. In order to ensure the rotational drive between the wheels by virtue of the friction acting on the frictional surfaces, a compression stress is required in order to force the frictional surfaces against each other. Alternatively the frictional pressure can also be generated if at least one of the two frictional surfaces is elastically prestressed in the transverse direction and forced against the other frictional surface.

In addition, DE-U1-94 07 305 discloses a manual device for transferring a film from a supporting strip to a substrate in which the drive connection between the supply wheel and the take-up wheel is formed by a friction wheel element arranged in the radial direction flexibly and coaxially relative to the take-up wheel. The friction wheel element rests via a wheel circumferential outer surface against a circumferential surface section of a counter-wheel arranged coaxially relative to the supply wheel in order to generate a frictional force transfer and application region. This manual device is intended to permit in a simple manner the maintenance of an optimum supporting strip tension in very narrow tolerance ranges.

SUMMARY OF THE INVENTION

In accordance with the principles of the present invention, an improved drive connection as well as an integrated slip coupling of a manual device for transferring a film from a supporting strip or tape carrier to a substrate are provided. For the sake of simplicity, the combination of film and tape carrier is referenced herein as "tape" and the device, as a whole, is referenced herein as a "tape applicator."

In particular, each of the supply wheel and the take-up wheel has a wheel wall. The wheel wall of one of the wheels (e.g., the take-up wheel) is clamped in a slit in the wheel wall of the other wheel (e.g., the supply wheel). Thus, a uniform transfer of torque between the two wheels is ensured at all times. In the drive connection formed according to the present invention together with the integrated slip coupling, no pretensioning in particular is necessary in order to ensure the frictional contact between the supply and take-up wheels.

In a further embodiment of the present invention, the supply wheel, take-up wheel and application device may be integrated in a cartridge that can be inserted into a housing preferably via a corresponding insertion opening in the housing.

The take-up wheel and/or the supply wheel may have a tensioning device for tensioning the tape carrier or tape. In addition, the take-up wheel may be provided with a reverse lock in order to prevent rotation of the take-up wheel in a direction causing unwinding of the tape carrier from the take-up wheel.

BRIEF DESCRIPTION OF THE DRAWINGS

The invention is illustrated in more detail hereinafter with the aid of preferred embodiments and with reference to the accompanying drawings, in which.

DETAILED DESCRIPTION OF THE INVENTION

Figure 1:
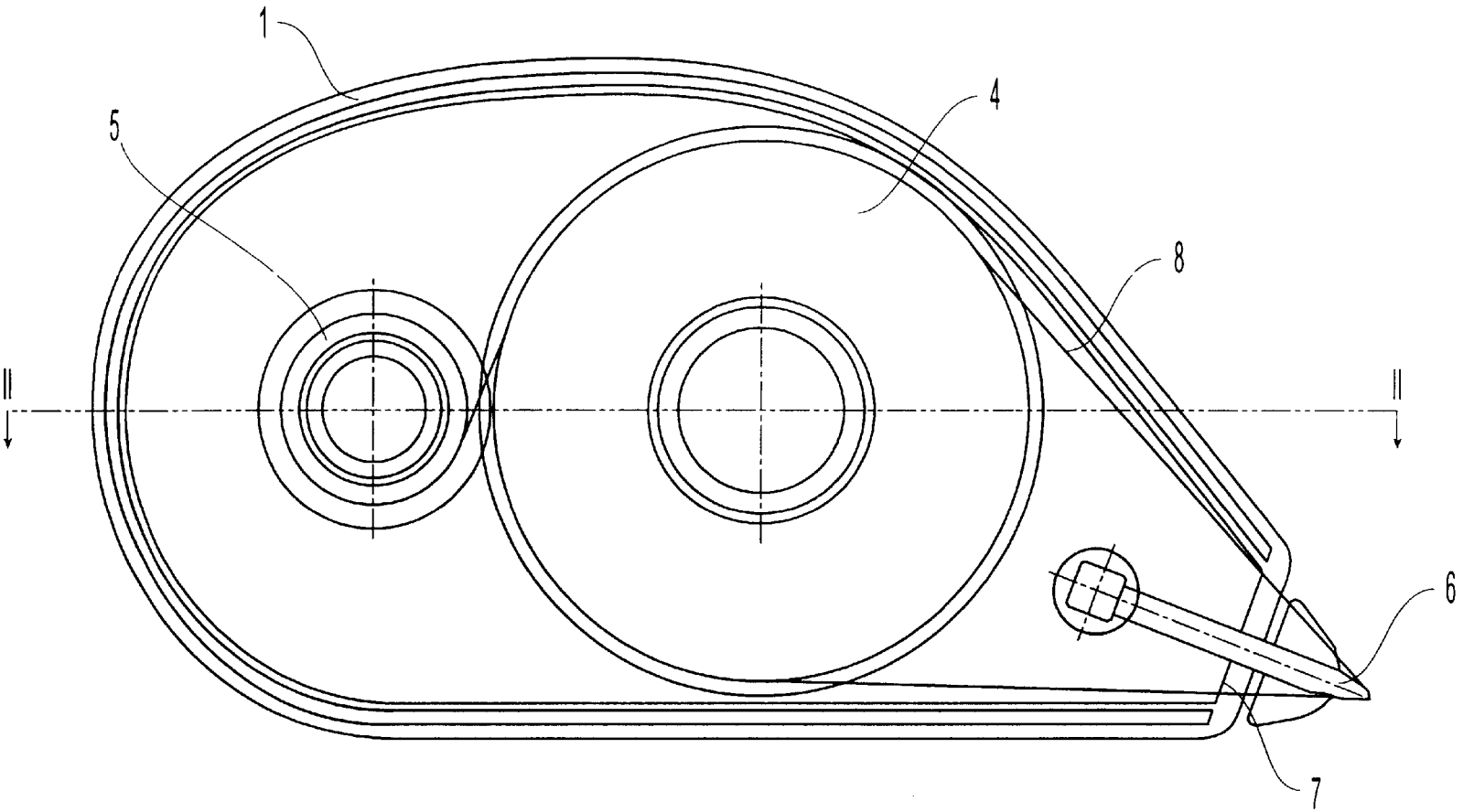
FIG. 1 is a sectional view of a first embodiment of a tape applicator according to the present invention along the line II of FIG. 2.
Figure 2:
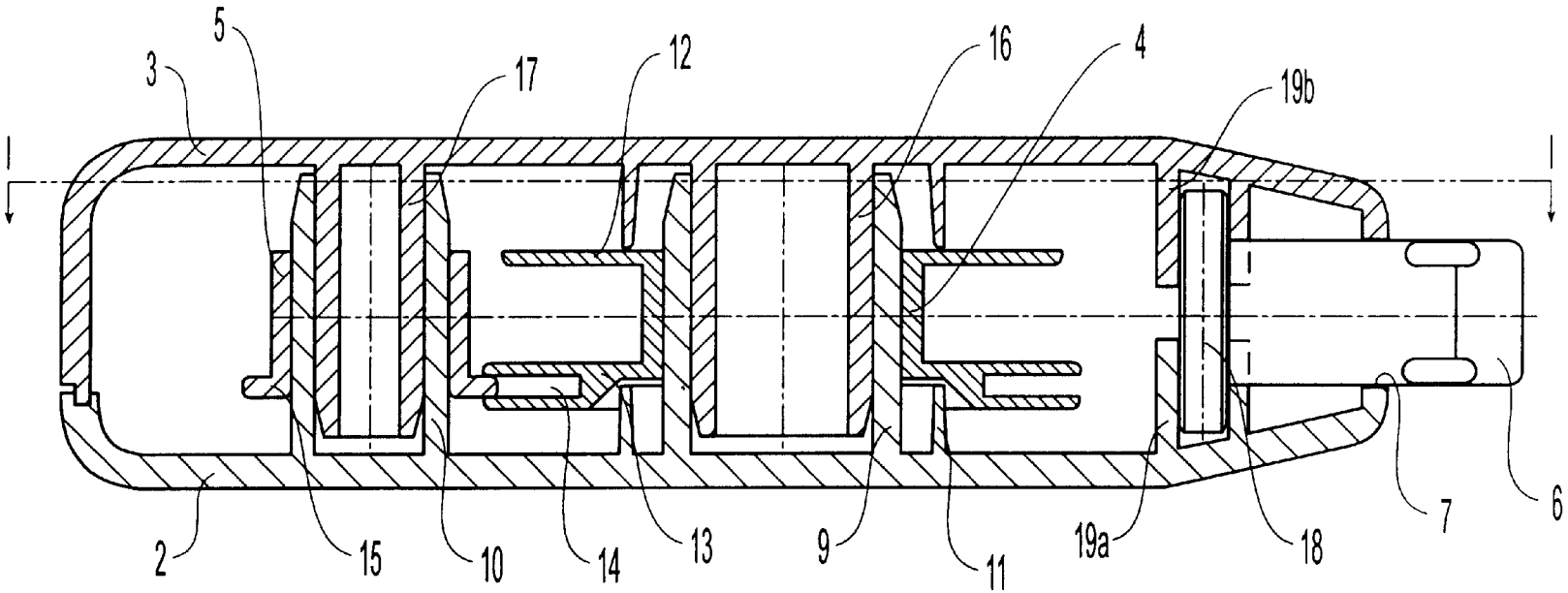
FIG. 2 is a sectional view of the tape applicator of FIG. 1 along the line II—II of FIG. 1.

A first embodiment of a manual device for transferring a film from a supporting strip to a substrate ("tape applicator") is described in detail with the aid of the two sectional representations shown in FIGS. 1 and 2. The tape applicator of FIGS. 1 and 2 is suitable in particular for transferring films of a covering and/or coloured material. For transferring an adhesive film, a press roller is preferably used instead of the applicator tip 6 of the embodiment of FIGS. 1 and 2.

The manual device according to the first embodiment substantially comprises a housing 1 including a housing lower body shell 2, a housing upper body shell 3, a supply wheel 4 rotatably mounted in housing 1, a take-up wheel 5 rotatably mounted in housing 1, and an application device 6 in the form of an applicator tip that projects from housing 1 through an outlet opening 7 in housing 1 at its front lower corner region ("use position"). A tape carrier or tape carrier 8, coated on one side with a film, is guided in turn from supply wheel 4, around applicator tip 6, to take-up wheel 5.

All the parts of the manual device described hereinbefore and also still to be described are preferably formed from plastics material and may be manufactured, with the exception of the tape carrier 8, by injection molding.

The two wheels 4 and 5 are arranged radially displaced relative to each other and are in each case rotatably mounted on a supporting plate which preferably is a part of housing 1. In the embodiment of FIGS. 1 and 2, the supporting plate is lower body shell 2. In particular, wheels 4 and 5 are supported on hollow axle boss 9 and 10 provided on housing lower body shell 2. In this connection, at least supply wheel 4 rests against a lug 11 that runs concentric to axle boss 9 and around the latter, so that wheels 4, 5 are positioned in housing 1 in such a way that tape carrier 8 runs exactly through the middle of housing 1 and at the height of applicator tip 6 (to be described in further detail below). Housing upper body shell 3 has two pins 16, 17 that can be pressed into the recesses of axle bosses 9, 10 of housing lower body shell 2 and thereby firmly close housing 1 of the tape applicator.

Supply wheel 4 is provided at each of its upper and lower axial ends with a wheel wall 12, 13, preferably formed as one piece and in the shape of a disk. Lower wheel wall 13 is provided with a slit 14. The depth of slit 14 is preferably about 5 mm and the width of slit 14 is preferably about 1 mm for reasons as will be appreciated. It will further become apparent that the dimensions of slit 14 may differ, depending on the dimensions of wheel wall 15 of take-up wheel 5 to be described below. The diameter of upper wheel wall 12 may be somewhat smaller than the diameter of lower wheel wall 13, thereby forming an assembly gap. Tape carrier 8 is guided between the two wheel walls 12, 13, supply wheel 4 being able to be spooled up to the larger external diameter of lower wheel wall 13.

A disc-shaped wheel wall 15, preferably formed as one piece, is likewise mounted at the lower axial end of take-up wheel 5, the external diameter of wheel wall 15 being substantially smaller than the external diameter of wheel walls 12, 13 of supply wheel 4. The thickness of wheel wall 15, the external diameter of wheel walls 13 and 15, and the mutual interspacing of the two wheels 4 and 5 are dimensioned so that wheel wall 15 of take-up wheel 5 can engage in slit 14 of wheel wall 13 of supply wheel 4. In this connection, the thickness of wheel wall 15 and/or slit 14 is very slightly larger than the width of slit 14 of supply wheel 4. The surfaces of wheel wall 15 and/or slit 14 may, in addition, be roughened so that the two wheels 4 and 5 may be in direct frictional contact with each other.

The frictional rotational movement thereby generated between supply wheel 4 and take-up wheel 5 ensures, through the corresponding torque transfer, a drive and slip action, the effect of which is that take-up wheel 5 is at all times driven at a rotational speed such that tape carrier 8 is always slightly tensioned and does not tear. The aforedescribed formation of the drive connection between wheel wall 15 and wheel wall 13 with slit 14 together with the frictional drive has the advantage compared to the prior art that a pretensioning of the elements in frictional contact with one another is not necessary. As wheel wall 15 is clamped in slit 14 of wheel wall 13, a uniform frictional force is thereby ensured at all times between wheels 4, 5.

Applicator tip 6 has at its end located in the housing 1 a pin 18 that is polygonal, for example square, in cross-section, and that is accommodated in a nonrotational manner in corresponding recesses 19*a* and 19*b* on housing lower body shell 2 or housing upper body shell 3. Pin 18 preferably is preferably rigidly connected to the remainder of applicator tip 6. The applicator tip itself may be formed of a soft, deformable plastics material. Alternatively, applicator tip 6 may be formed so as to be rigid and connected via an elastic intermediate piece to pin 18.

Figure 3:
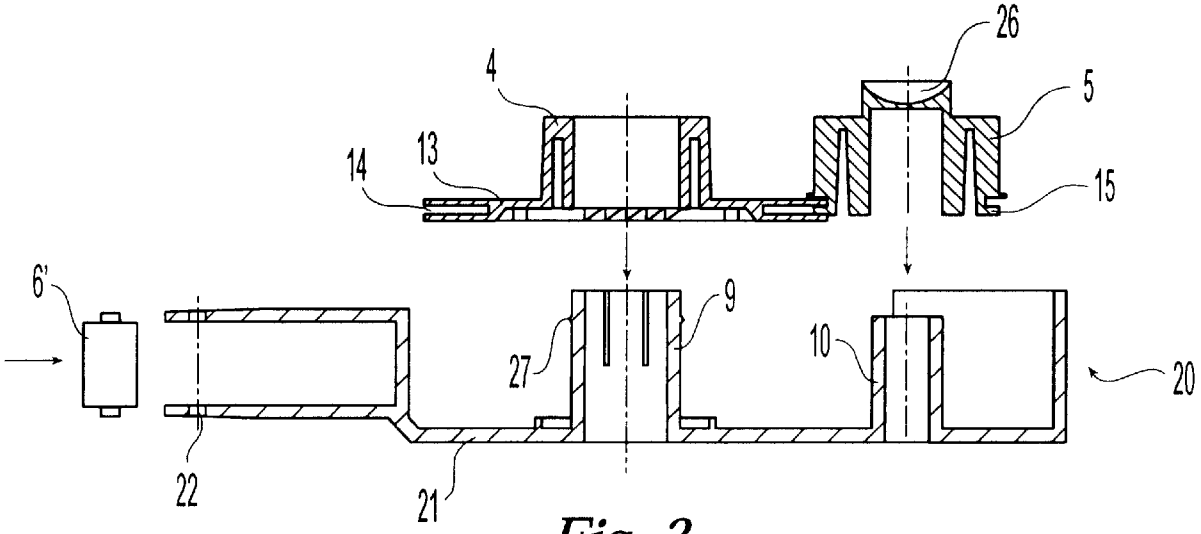
FIG. 3 is a sectional view of a first assembly step of a second embodiment of a tape applicator according to the present invention.

The second embodiment of a tape applicator according to the principles of the present invention is described in more detail hereinafter with the aid of two assembly drawing FIGS. 3 and 4. In contrast to the first embodiment, the tape applicator of the second embodiment includes a housing 1' in which a cartridge 20 may be inserted through a corresponding insertion opening 24. Cartridge 20 preferably is replaceable upon expending the tape it supplies.

Cartridge 20 includes a supporting plate 21 on which the two axle bosses 9 and 10 are formed, preferably as one piece, to receive supply wheel 4 and take-up wheel 5, respectively. The two wheels 4, 5 are in principle formed as in the aforedescribed first embodiment, and in particular have the same drive connection, between wheel wall 15 and wheel wall 13 with slit 14, together with integrated slip coupling produced by frictional drive. The embodiment of FIGS. 3 and 4 is intended for the transfer of an adhesive film from tape carrier 8 to a substrate, and cartridge 20 therefore contains an application device in the form of a rotatably mounted press roller 6' instead of an applicator tip 6 at its front end, the rotational axis of press roller 6' being accommodated in a corresponding fork-shaped receptacle 22. As illustrated in FIG. 3, supply wheel 4 and takeup wheel 5 are mounted together on the two axle bosses 9, 10 and engage with a lug 27 that moves on axle boss 9 for supply wheel 4.

Figure 4:
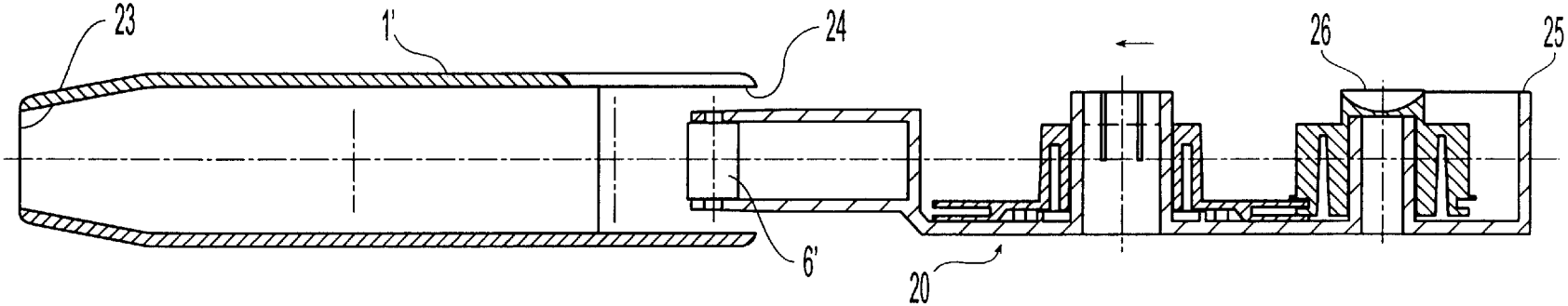
FIG. 4 is a sectional view of a second assembly step of the tape applicator of FIG. 3.

As illustrated in FIG. 4, cartridge 20, with the two wheels 4, 5 and press roller 6', are inserted into housing 1' through a corresponding insertion opening 24 in housing 1'. Cartridge 20 is, in this connection, inserted into housing 1' until press roller 6' projects from an outlet opening 23 in housing 1'. As illustrated in the embodiment of FIG. 4, opening 24 is in the rear of housing 1', and outlet opening 23 is in the front of housing 1', though other configurations are within the scope of the present invention. Insertion opening 24 may be closed by a wall 25 formed on supporting plate 21 of cartridge 20. In this use position, cartridge 20 engages in a catch device (not shown) or other engagement device in housing 1'. In order to replace cartridge 20, cartridge 20 can be released from the engagement device simply by applying a tractive force or, in addition, by actuating a decoupling device (not shown).

A groove 26 running in the radial direction may also be provided on the upper axial end of take-up wheel 5. When cartridge 20 is inserted, this groove 26 is freely accessible to the user from outside housing 1' via a corresponding opening in housing 1'. By means of this groove 26, take-up wheel 5 can be rotated externally by the user in the take-up direction of tape carrier 8 and tape carrier 8 may thus be tensioned by hand if necessary. In order to prevent rotation of take-up wheel 5 in the reverse direction and thus a take-off (unwinding) of the tape carrier 8 from the take-up spool 5, a reverse lock may be provided on take-up wheel 5 and associated axle boss 10. Such a reverse lock may be formed, for example, from a toothed section having a saw-tooth geometry rotating externally on axle boss 10, and a corresponding toothed section rotating internally on wheel 5, the latter toothed section engaging in the toothed section of axle boss 10. A similar reverse lock may be provided on supply wheel 4 in addition.

In the second embodiment of the tape applicator of the present invention, an applicator tip 6 may obviously be used instead of press roller 6' in order to provide manual device with a tape carrier 8. Alternatively, in the first embodiment it is also possible to provide take-up wheel 5 with a tensioning device 26 and/or a reverse lock.

It will be appreciated features described with respect to one embodiment typically may be applied to another embodiment, whether or not explicitly indicated. The various features hereinafter described may be used singly or in any combination thereof. Therefore, the present invention is not limited to only the embodiments specifically described herein.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. For example, a wheel wall of the supply wheel may be inserted in a slit in a wheel wall of the take-up wheel instead of the reverse arrangement described herein. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A device for transferring a film from a tape carrier to a substrate, said device comprising:

a supply wheel having at least one disc-shaped supply wheel wall, said supply wheel being configured to carry a tape carrier coated with a film;

a take-up wheel having at least one disc-shaped take-up wheel wall, said take-up wheel being configured to receive the tape carrier after separation of the film therefrom; and an application device positioned with respect to said supply wheel and said take-up wheel to present a tape carrier coated with film, as supplied from said supply wheel; to a substrate;

wherein:

said supply wheel and said take-up wheel are displaced radially with respect to each other;

one of said supply wheel wall and said take-up wheel wall is formed with a slit;

the other of said supply wheel wall and said take-up wheel wall engages in said slit to form a drive connection with a slip coupling by a friction drive;

said supply wheel is driven by drawing off a tape carrier carried thereon; and said drive connection drives said take-up wheel.

2. A device according to claim 1, wherein a roughened surface is provided on one of said slit and said other of said supply wheel wall and said take-up wheel wall engaged in said slit.

3. A device according to claim 1, wherein one of said supply wheel and said take-up wheel has a tensioning device for tensioning a tape carrier carried thereby.

4. A device according to claim 1, wherein said take-up wheel has a reverse lock for preventing rotation of said take-up wheel in a direction causing unwinding of a tape carrier therefrom.

5. A device according to claim 1, wherein said take-up wheel is driven at such a rotational speed that a tape carrier received by said take-up wheel always remains tensioned.

6. A device according to claim 5, wherein one of said supply wheel and said take-up wheel has a tensioning device for tensioning a tape carrier carried thereby.

7. A device according to claim 6, wherein said take-up wheel has a reverse lock for preventing rotation of said take-up wheel in a direction causing unwinding of a tape carrier therefrom.

8. A device according to claim 5, wherein said supply wheel and said take-up wheel are mounted on a supporting plate.

9. A device according to claim 1, wherein said supply wheel and said take-up wheel are mounted on a supporting plate.

10. A device according to claim 9, wherein said supporting plate is apart of a housing.

11. A device according to claim 9, wherein said supporting plate is a part of a cartridge.

12. A device according to claim 11, further comprising a housing configured to receive said cartridge through an insertion opening in said housing.

13. A device according to claim 12, wherein said cartridge further comprises a wall configured to close said insertion opening in said housing when said cartridge is inserted into said housing.

14. A device according to claim 13, wherein said cartridge engages with an engagement device in said housing.

* * * * *